US011454147B2

(12) United States Patent
Wainscott et al.

(10) Patent No.: US 11,454,147 B2
(45) Date of Patent: Sep. 27, 2022

(54) INTERNAL COMBUSTION ENGINE WITH PURGE SYSTEM

(71) Applicant: Caterpillar Inc., Peoria, IL (US)

(72) Inventors: Nicholas Edwin Wainscott, Rossville, IN (US); Kyle Robert Brewer, Lafayette, IN (US); Rodney Allen Lawrence, Frankfort, IN (US); Scott Byron Fiveland, Nokomis, FL (US); Yongxian Gu, West Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/026,770

(22) Filed: Sep. 21, 2020

(65) Prior Publication Data

US 2022/0090526 A1 Mar. 24, 2022

(51) Int. Cl.
*F01M 13/04* (2006.01)
*F01M 13/02* (2006.01)

(52) U.S. Cl.
CPC ..... *F01M 13/023* (2013.01); *F01M 13/0416* (2013.01); *F01M 2013/0411* (2013.01)

(58) Field of Classification Search
CPC .. Y02T 10/12; F01M 2013/027; F01M 13/00; F01M 13/04; F01M 13/0011; F01M 2013/0083; F01M 13/023; F01M 2013/0038; F01M 13/022; F01M 11/00
USPC ..... 123/572–574
See application file for complete search history.

(56) References Cited

U.S. PATENT DOCUMENTS 3,227,010 A * 1/1966 Daubuer ..... F01M 13/022 408/1 R
4,712,532 A * 12/1987 Ura ..... F01M 13/025 123/572
4,724,807 A * 2/1988 Walker ..... F01M 13/04 123/196 A
6,591,796 B1 * 7/2003 Scott ..... F01M 11/02 123/90.55
6,883,483 B1 * 4/2005 Knudsen ..... F01L 1/146 123/90.37

(Continued)

FOREIGN PATENT DOCUMENTS

CN 108894851 A 11/2018
DE 102008045697 A1 * 3/2010 ..... F01M 13/04

(Continued)

*Primary Examiner* — George C Jin
*Assistant Examiner* — Teuta B Holbrook
(74) *Attorney, Agent, or Firm* — Schwegman Lundberg & Woessner, P.A.

(57) ABSTRACT

Apparatuses, systems and methods are disclosed including an internal combustion engine. The internal combustion engine can include an engine block defining a combustion cylinder and a crankcase, a piston moveable within the combustion cylinder; a cylinder head coupled to the engine block adjacent to and in fluid communication with the combustion cylinder, and a purge system. The purge system can be in fluid communication with the crankcase. The purge system can supply air to the crankcase and to the cylinder head. The purge system can comprise a valve cover coupled to the cylinder head, a breather coupled to the valve cover, and a fumes disposal line coupled with the breather. The fumes disposal line can transport fumes from the breather and away from the cylinder head.

16 Claims, 7 Drawing Sheets

(56) References Cited

U.S. PATENT DOCUMENTS

2002/0003056 A1* 1/2002 Coughlin ..... F02F 7/006 180/219
2002/0046743 A1* 4/2002 Moren ..... F01M 13/023 123/572
2004/0093859 A1* 5/2004 Schmeichel ..... B01D 53/944 60/299
2004/0144698 A1* 7/2004 Hilpert ..... B04C 5/26 209/725
2005/0000496 A1* 1/2005 Norrick ..... F02M 25/06 123/563
2008/0011280 A1* 1/2008 Tawarada ..... F02M 35/104 123/572
2008/0083398 A1* 4/2008 Reichardt ..... F01M 13/0416 123/572
2009/0025662 A1* 1/2009 Herman ..... F01M 13/04 123/41.86
2011/0023850 A1* 2/2011 Karlovsky ..... F01M 13/00 123/573
2011/0073083 A1* 3/2011 Shiraishi ..... F01M 13/02 123/574
2011/0277733 A1* 11/2011 Spix ..... F01M 13/023 123/574
2014/0034030 A1 2/2014 Jaasma
2014/0290634 A1* 10/2014 Slaughter ..... F01M 13/0416 123/573
2015/0040852 A1* 2/2015 Pursifull ..... F02D 9/02 123/184.56
2015/0240732 A1* 8/2015 Makihara ..... F02B 37/183 60/602
2015/0300224 A1* 10/2015 Kira ..... B01D 45/16 55/461
2016/0090883 A1* 3/2016 Nishiguchi ..... F01M 13/0416 123/572
2016/0177791 A1* 6/2016 Kira ..... F01M 13/0416 123/573
2016/0194988 A1* 7/2016 Lawrence ..... F01M 13/0416 123/573
2016/0265404 A1* 9/2016 Fujii ..... F01M 13/0416
2018/0187582 A1* 7/2018 Yaguchi ..... B60T 17/02
2019/0048805 A1* 2/2019 Pursifull ..... F02M 35/10222
2019/0085743 A1* 3/2019 Wyatt ..... F01M 13/04

FOREIGN PATENT DOCUMENTS

DE 202012005909 U1 * 8/2013 ..... F01M 13/00
EP 3674522 A1 * 7/2020 ..... F01M 13/0416
JP 2005133599 A * 5/2005

* cited by examiner

INTERNAL COMBUSTION ENGINE WITH PURGE SYSTEM

TECHNICAL FIELD

The present disclosure relates to internal combustion engines such as those for vehicles or stationary power generation. More particularly, the present disclosure relates to internal combustion engines having a ventilation system for diluting un-combusted fumes.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. A portion of the combustion gases (termed "blowby") may escape the combustion chamber past the piston and enter undesirable areas of the engine such as the crankcase. Blowby can contain un-combusted fuel and explosive gases. In rare cases, un-combusted fuel and/or explosive gases can build within the engine such as within the crankcase. The un-combusted fuel and/or explosive gases can result in an explosion if not properly mitigated such as by a relief valve. Crankcase ventilation systems are known in combustion engines to vent blowby gases within the crankcase. For example, United States Patent Application Publication No. 2011/0277733 discloses an example of a crankcase ventilation system. However, United States Patent Application Publication No. 2011/0277733 recycles blowby gases back to the combustion chamber of the engine block such that the blowby gases do not pass from the cylinder head to ambient via dedicated components such as a breather. Additionally, the ventilation system of United States Patent Application Publication No. 2011/0277733 does not direct venting gases into the cylinder head.

SUMMARY

In an example according to this disclosure, an internal combustion engine is disclosed. The internal combustion engine can include an engine block defining a combustion cylinder and a crankcase, a piston moveable within the combustion cylinder; a cylinder head coupled to the engine block adjacent to and in fluid communication with the combustion cylinder, and a purge system. The purge system can be in fluid communication with the crankcase. The purge system can supply air to the crankcase and to the cylinder head. The purge system can comprise a valve cover coupled to the cylinder head, a breather coupled to the valve cover, and a fumes disposal line coupled with the breather. The fumes disposal line can transport fumes from the breather and away from the cylinder head.

In another example according to this disclosure, a method of diluting products of combustion with compressed air within an internal combustion engine is disclosed. The method can include directing the compressed air from an intake manifold of the internal combustion engine to a crankcase of the internal combustion engine, passing the compressed air from the crankcase to a plurality of cylinder heads of the internal combustion engine, passing fumes from each of the plurality of cylinder heads through a dedicated one of a plurality of breathers to a collection line with the compressed air and passing the fumes from the plurality of breathers along the collection line to an outlet.

In yet another example according to this disclosure, a purge system for supplying compressed air to an internal combustion engine is disclosed. The system can include an inlet configured to couple with an intake manifold of the internal combustion engine and supply the compressed air from the intake manifold to a crankcase of the internal combustion engine, a valve cover configured to couple to a cylinder head of the internal combustion engine, a breather configured to couple to the valve cover and a fumes disposal line configured to couple with the breather, wherein the fumes disposal line is configured to transport fumes from the breather and away from the cylinder head.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to internal combustion engines, and to systems and methods for supplying air to the internal combustion engine to dilute volatile fumes within the engine. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

As used herein, a component that is referred to as being "positioned on," "engaged to," "connected to" or "coupled to" another component can be directly positioned on, engaged, connected or coupled to the other component without intervening components or can have intervening components so as to be indirectly positioned on, engaged, connected or coupled to the other component. In some cases, this disclosure makes a distinction between components directly positioned on, engaged, connected or coupled to the other component and those that are indirectly positioned on, engaged, connected or coupled to the other component.

Figure 1:
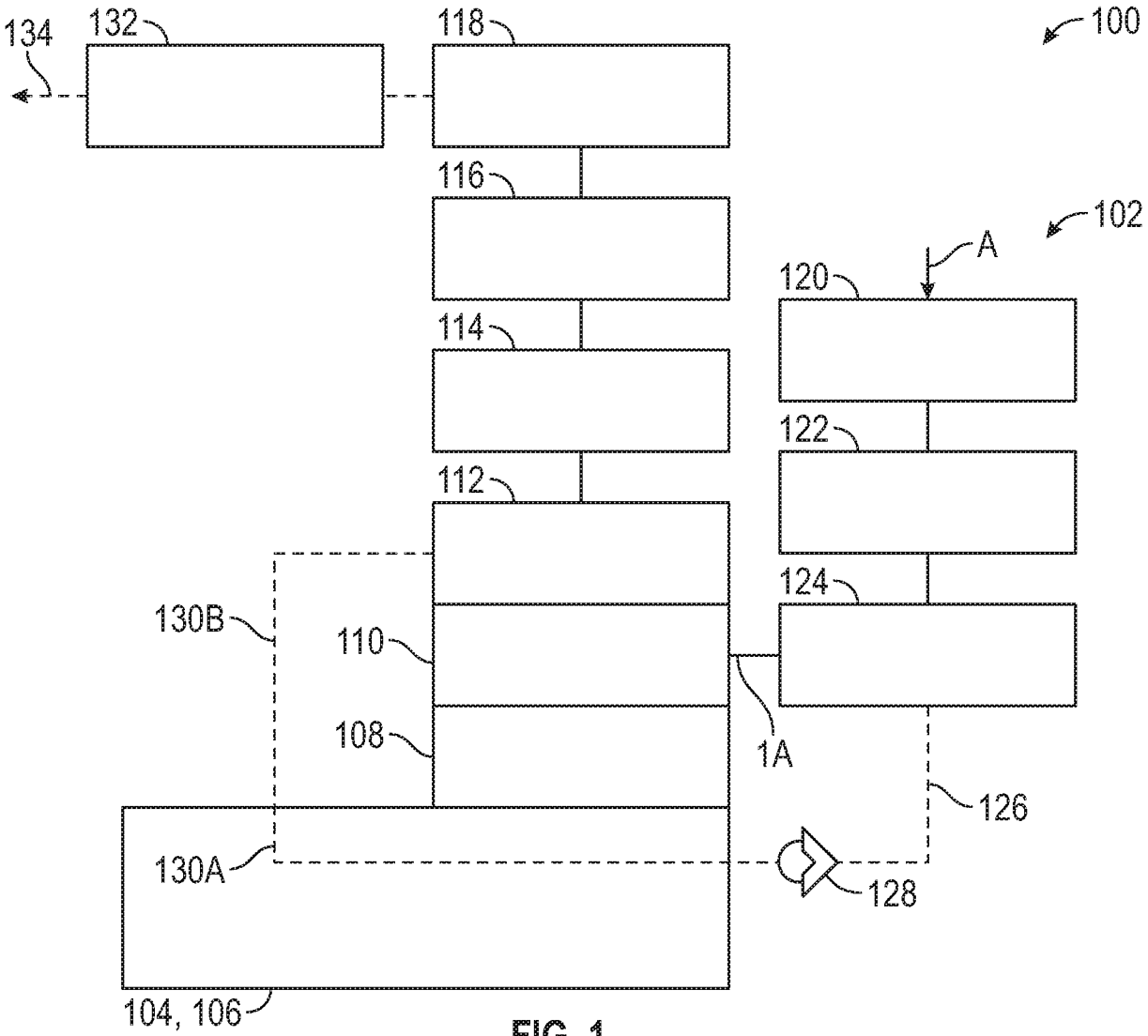
FIG. 1 is a schematic illustration depicting an example internal combustion engine including a purge system in accordance with an example of this disclosure.

FIG. 1 depicts an example schematic illustration of an engine 100 in accordance with this disclosure. The engine 100 can be used for power generation such as for the propulsion of vehicles or other machinery. The engine 100 can include various power generation platforms, including, for example, an internal combustion engine, whether gasoline, natural gas or diesel. It is understood that the present disclosure can apply to any number of piston-cylinder arrangements and a variety of engine configurations including, but not limited to, V-engines, inline engines, and horizontally opposed engines, as well as overhead cam and cam-in-block configurations.

In some applications, the internal combustion engines disclosed here are contemplated for use in gas compression. Thus, the internal combustion engines can be used in stationary applications in some examples. In other applications the internal combustion engines disclosed can be used with vehicles and machinery that include those related to various industries, including, as examples, construction, agriculture, forestry, transportation, material handling, waste management, etc.

The engine 100 can include a purge system 102, an engine block 104, a crankcase 106, a combustion cylinder 108, a cylinder head 110, a rocker box 112, a valve cover 114, a breather 116, and a fumes disposal passageway 118. The purge system 102 can include a turbocharger 120, an aftercooler 122, an intake manifold 124 and an inlet passageway 126. The inlet passageway 126 can include a check valve 128 or other valve configured to prevent reverse flow when the pressure within the intake manifold 124 is lower than the pressure within the crankcase 106. However, the check valve 128 is not required in all examples as operational criteria such as loads and boost levels dictate.

In the example of FIG. 1, the purge system 102 can be part of the original manufacture of the engine 100 or can be a retrofitted system that is added to the engine 100 during maintenance, upgrade or the like. As will be discussed in further detail subsequently, the purge system 102 can be in fluid communication with the crankcase 106 such as via the inlet passageway 126. The purge system 102 can be configured to supply air to the crankcase 106 and through the engine block 104 or through other components (not shown) to the cylinder head 110. The air the purge system 102 supplies can act to ventilate the crankcase 106 and other components such as the cylinder head 110, the rocker box 112, etc. This ventilation can dilute un-combusted fuel, explosive gases and/or volatiles below a lower explosive limit so as to prevent or reduce the likelihood of an explosion within the engine 100. The un-combusted fuel, explosive gases, other volatiles and air including air provided by the purge system are collectively referred to herein as "fumes" in some cases for simplicity.

The purge system 102 can include connected passageways (some specifically illustrated and referenced in FIG. 1) that are in fluid communication through the engine block 104, the crankcase 106, the cylinder head 110, the rocker box 112, the valve cover 114 and/or the breather 116 to the fumes disposal passageway 118. The terms "passage", "passages", "passageway", "passageways", "line" or "lines" as used herein should be interpreted broadly. These terms can be features defined by the various components of the engine illustrated in the FIGURES or can be formed by additional components (e.g., a hose, pipe, manifold, cavity etc.) as known in the art. These additional components can be external to the engine 100 in some examples. Passageways can also connect the turbocharger 120, the aftercooler 122 and the intake manifold 124 as further described herein.

The purge system 102 can include passages/lines and other components such as those shown in FIG. 1. Air (designated "A" in FIG. 1) for the purge system 102 can be collected at an intake and passed to the turbocharger 120. The air from the intake can be obtained from atmosphere or another source. The air can pass to the turbocharger 120, which can be configured to receive and compress the air. The compressed air can pass from the turbocharger 120 to the aftercooler 122. Thus, the aftercooler 122 can be in fluid communication with the turbocharger 120. The aftercooler 122 can be configured to receive and cool the compressed air.

From the aftercooler 122, the air can pass to the intake manifold 124. The intake manifold 124 can be in fluid communication with the aftercooler 122. The intake manifold 124 can be configured to pass a first portion of the compressed air comprising an intake air (designated "IA" in FIG. 1) to the cylinder head 110 and pass a second portion of the compressed air comprising the ventilation or purge air to the crankcase 106.

As shown in FIG. 1, the purge system 102 can include the inlet passageway 126, which can connect with the engine block 104 (fluidly communicating with the crankcase 106) from the intake manifold 124. Thus, the inlet passageway 126 allows for fluid communication between the intake manifold 124 and the crankcase 106. The engine block 104 can form one or more internal passages 130A in addition to the crankcase 106 and the combustion cylinder 108. These one or more internal passages 130A can communicate with the crankcase 106 and can allow some or all of the air of the purge system 102 to pass through the engine block 104 to the cylinder head 110 and/or rocker box 112. The one or more internal passages 130A can comprise one or more oil drain cavities or other line, for example. The one or more internal passages 130A can be in fluid communication with one or more internal passages 130B of the cylinder head 110 and/or rocker box 112, for example. The one or more internal passages 130B can comprise oil drain cavities or the like.

The engine block 104 can comprise a housing and can form the crankcase 106, combustion cylinder 108, the one or more internal passages 130A and other features not specifically illustrated in FIG. 1. The combustion cylinder 108 can be configured to house one or more pistons (not shown) therein. Each piston can be moveable within the combustion cylinder 108 and can be coupled to a shaft (not shown) within the crankcase 106. Movement of the shaft can facilitate a reciprocal movement of the piston within the combustion cylinder 108. Although referred to as a cylinder here, the combustion cylinder 108 can have other shapes known in the art.

The cylinder head 110 can be coupled to the engine block 104 adjacent the piston and the combustion cylinder 108. The cylinder head 110 can define a part of a combustion chamber (along with the combustion cylinder 108), an intake air passageway, an outlet passageway for products of combustion, valve(s) housing, other passageways, etc. as known in the art.

The rocker box 112 can be positioned on the cylinder head 110 such that the cylinder head 110 can be positioned between the rocker box 112 and the engine block 104 including the combustion cylinder 108. The rocker box 112 can be part of or can be directly or indirectly coupled to the cylinder head 110 as an additional component. Thus, the rocker box 112 can be configured to couple to the cylinder head 110 according to some examples. Although illustrated as a separate component in FIG. 1, the present disclosure recognizes the rocker box 112 can be part of the cylinder head 110 according to other examples.

The rocker box 112 can include components of the inlet and/or outlet valves, passageways, and other features as known in the art. The valve cover 114 can couple directly or indirectly to the rocker box 112. Thus, the valve cover 114 can be configured to couple to the cylinder head 110 (via the rocker box 112 if the rocker box 112 is a separate component as with the example of FIG. 1). The valve cover 114 can include one or more passageways that are in fluid communication with passageways of the purge system 102 through cylinder head 110 and/or rocker box 112 to allow for the passage of fumes.

The breather 116 can couple directly or indirectly to the valve cover 114. Therefore, the breather 116 can be configured to couple to the valve cover 114. The breather 116 can comprise a mechanism that separates the oil droplets and oil mist from the blowby gas in order to prevent the oil droplets and oil mist contained in the blowby gas from being taken out along the flow of the blowby gas. By way of example, the breather 116 can include one or more separation mechanisms such as an oil separation valve, splasher plate, serpentine passage, mesh or other obstruction. The breather 116 can differ from those in typical use in that it can have an outlet/connection (shown subsequently) that is configured to couple with the fumes disposal passageway 118. The fumes disposal passageway can be configured to couple with the breather 116 and can be configured with an outlet 132 allowing passage of fumes 134 to atmosphere or another location such as away from the engine 100.

Figure 2:
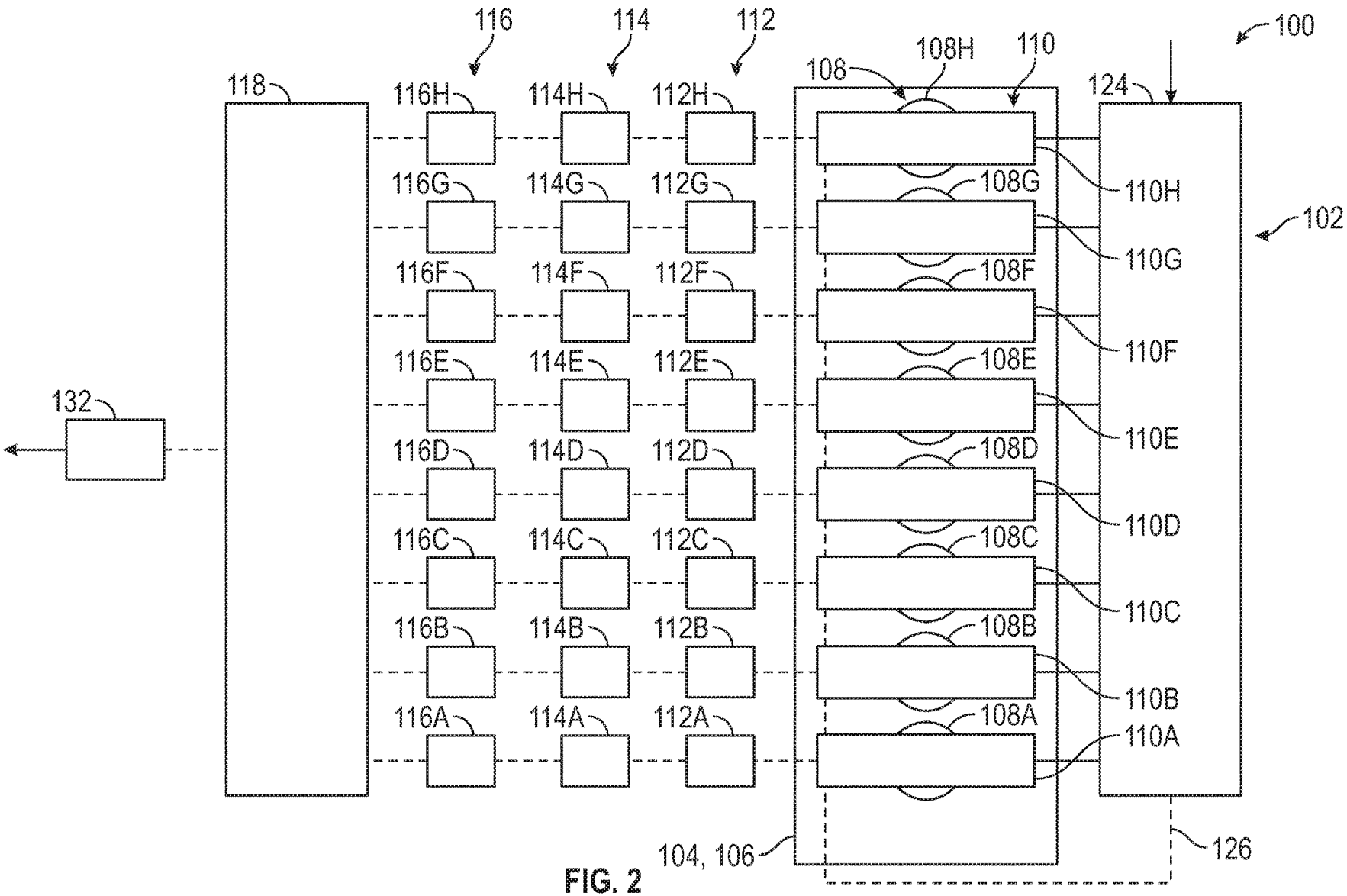
FIG. 2 is a second schematic illustration of the engine and the purge system of FIG. 1.

FIG. 2 provides a schematic illustration of the engine 100 and the purge system 102 at a different level of detail than FIG. 1. As such, some of the components and features of FIG. 1 are now shown in FIG. 2. As illustrated in FIG. 2, the engine 100 can include the intake manifold 124, the engine block 104, the crankcase 106, the combustion cylinder 108, the cylinder head 110, the rocker box 112, the valve cover 114, the breather 116, the fumes disposal passageway 118, and the outlet 132.

FIG. 2 differs from FIG. 1 in that it illustrates the engine 100 and the purge system 102 can have a plurality of some of the components described above. These can be arranged in parallel. Thus, the combustion cylinder 108 can include a plurality of combustion cylinders 108A, 108B, 108C, 108D, 108E, 108F, 108G and 108H. The cylinder head 110 can include a plurality of cylinder heads 110A, 110B, 110C, 110D, 110E, 110F, 110G and 110H. The rocker box 112 can include a plurality of rocker boxes 112A, 112B, 112C, 112D, 112E, 112F, 112G and 112H. The valve cover 114 can include a plurality of valve covers 114A, 114B, 114C, 114D, 114E. 114F, 114G and 114H. The breather 116 can include a plurality of breathers 116A, 116B, 116C, 116D, 116E, 116F, 116G and 116H. The number of these components is purely exemplary.

Each of the plurality of cylinder heads 110A, 110B, 110C, 110D, 110E, 110F, 110G and 110H can be coupled (directly or indirectly) to an associated one of the plurality of valve covers 114A, 114B, 114C, 114D, 114E, 114F, 114G and 114H and one of the plurality of breathers 116A, 116B, 116C, 116D, 116E, 116F, 116G and 116H.

The purge system 102 can include a plurality of passageways in fluid communication (illustrated with dashed lines) extending in parallel between and/or through the plurality of components described above. The passageways allow for passage of the fumes through these components to the fumes disposal passageway 118 and the outlet 132. As again illustrated in FIG. 2, the intake manifold 124 can be configured to pass the first portion of the compressed air comprising an intake air (designated "IA" in FIG. 1) in parallel passageways to the cylinder heads 110A, 110B, 110C, 110D, 110E, 110F, 110G and 110H and pass the second portion of the compressed air comprising the ventilation or purge air to the crankcase 106 such as via the inlet passageway 126.

As shown in FIG. 2, the fumes disposal passageway 118 can be connected in series to each of the plurality of breathers 116A, 116B, 116C, 116D, 116E, 116F, 116G and 116H. The outlet 132 of the fumes disposal passageway 118 can be positioned between a two most inner (here breathers 116D and 116E) of the series of the plurality of breathers 116A, 116B, 116C, 116D, 116E, 116F, 116G and 116H.

Figure 3:
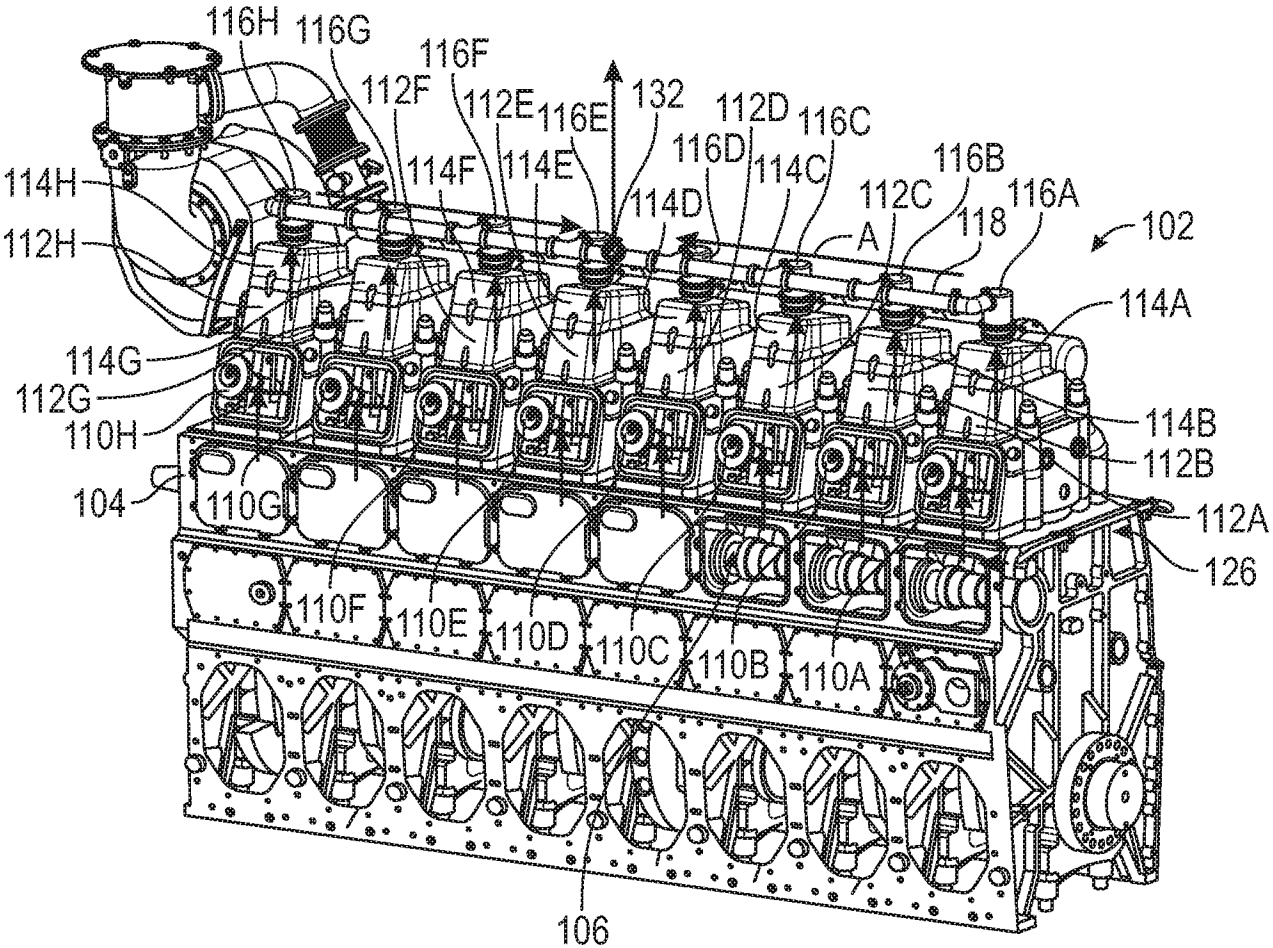
FIG. 3 is a perspective view of portions of the engine with the purge system of FIGS. 1 and 2 according to an example of this disclosure.
Figure 3A:
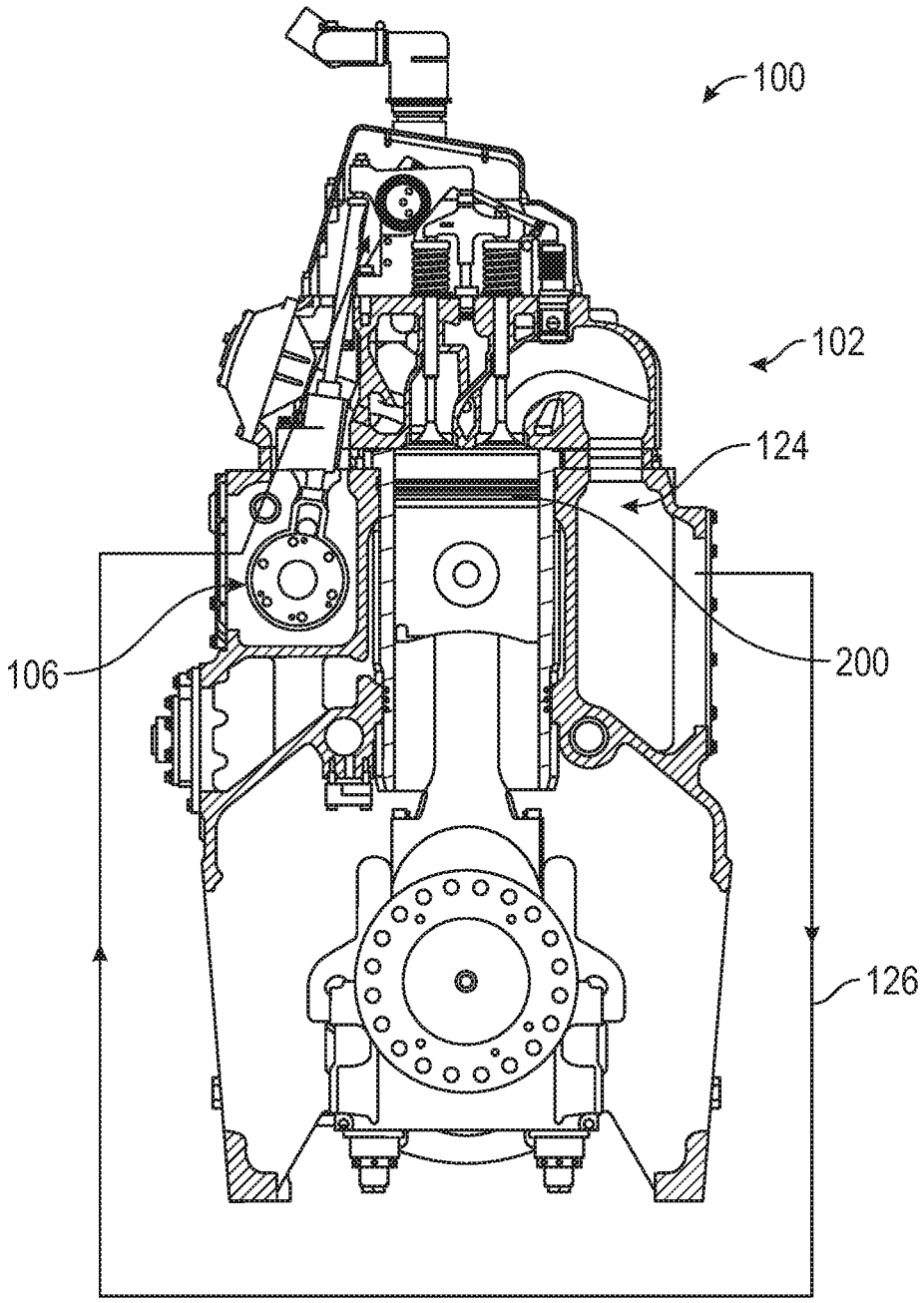
FIG. 3A is a cross-sectional view of the engine and purge system of FIG. 3.

FIG. 3 shows a perspective view of the engine 100 and illustrates the purge system 102. FIG. 3A shows a cross-sectional view of the engine 100 and purge system 102 of FIG. 3 and illustrates a piston 200 moveable within one of the plurality of combustion cylinders 108A, 108B, 108C, 108D, 108E, 108F. 108G and 108H. The purge system 102 can facilitate the flow of air A through the engine 100 as illustrated by arrows in FIG. 3. As illustrated with arrows, the air A can pass through the inlet passageway 126 (shown in FIG. 3 only), through the crankcase 106 and from the crankcase 106 through the cylinder block 104 to the plurality of cylinder heads 110A, 110B, 110C, 110D, 110E, 110F, 110G and 110H. The air dilutes and becomes fumes as previously described. The fumes can pass from the plurality of cylinder heads 110A, 110B, 110C, 110D, 110E, 110F, 110G and 110H through the plurality of rocker boxes 112A, 112B, 112C, 112D, 112E, 112F, 112G and 112H to the plurality of valve covers 114A, 114B, 114C, 114D, 114E, 114F, 114G and 114H. The fumes can pass through the plurality of valve covers 114A, 114B, 114C, 114D, 114E, 114F, 114G and 114H to the plurality of breathers 116A, 116B, 116C, 116D, 116E, 116F, 116G and 116H. The fumes can pass through the plurality of breathers 116A, 116B, 116C, 116D, 116E, 116F, 116G and 116H to the fumes disposal passageway 118. The fumes can pass along the fumes disposal passageway 118 to the outlet 132 as shown in FIG. 3.

Figure 4:
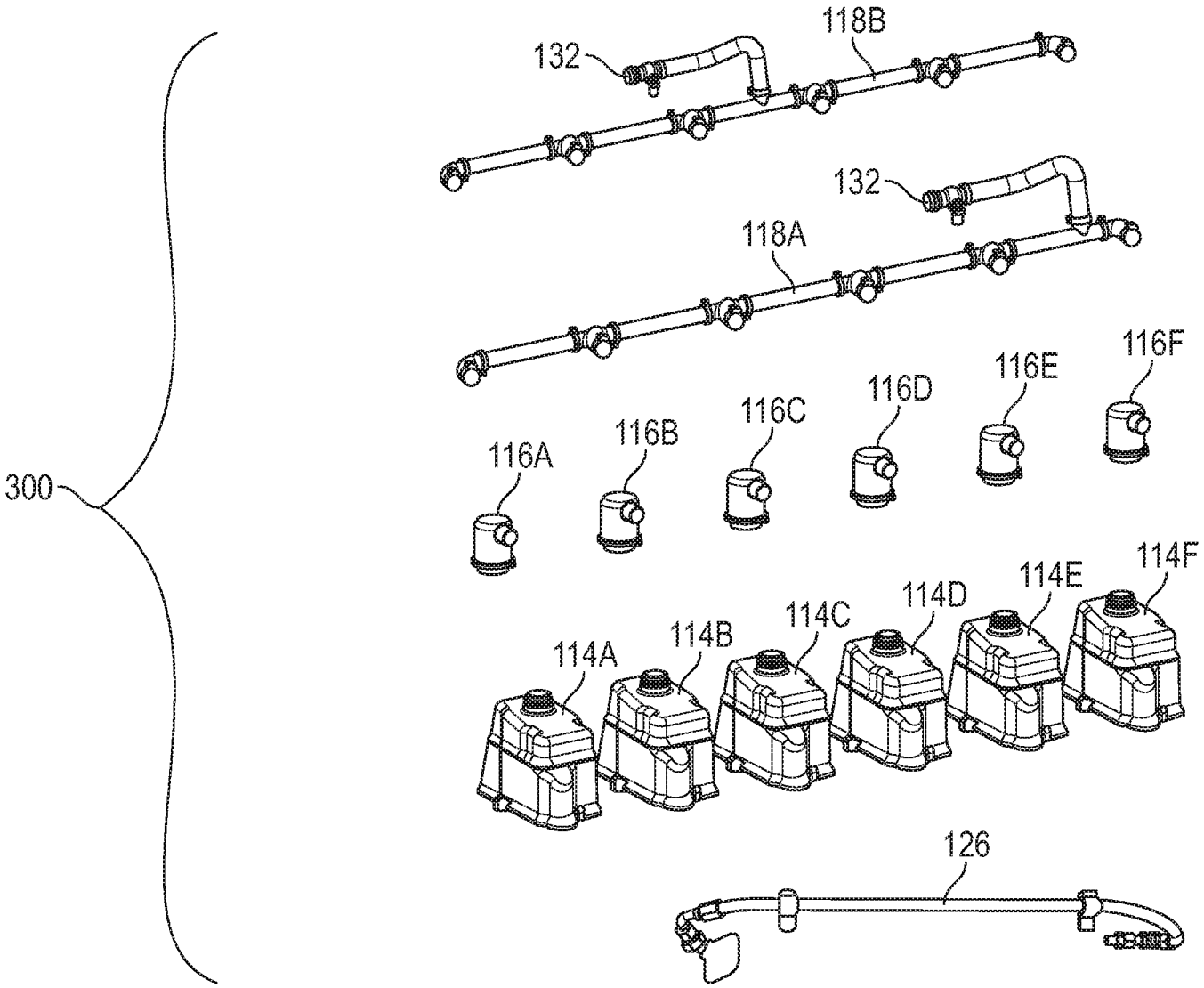
FIG. 4 is a perspective view of components of a purge system according to another example of this disclosure.

FIG. 4 shows a perspective view of a purge system 300 according to another example. This purge system 300 can be retrofit to an existing engine to provide for the benefits of diluting and removing engine fumes as discussed herein. The purge system 300 can include an inlet passageway 126, the plurality of valve covers 114A, 114B, 114C, 114D, 114E, and 114F, the plurality of breathers 116A, 116B, 116C, 116D, 116E, and 116F, one or more fumes disposal passageways 118A and/or 118B and the outlet 132. The purge system 300 can be configured to assemble together as previously illustrated and described with reference to FIGS. 1-3A. As shown in FIG. 4, the inlet passageway 126 and the fumes disposal passageways 118A and/or 118B can comprise lines such as hose, pipe, etc. The number of valve covers, breathers, etc. can vary as desired to match the number of cylinder heads of the engine. The outlet 132 can be located at a central location such as between the two inner most connections with the two inner most breathers (e.g., 116C and 116D) when the plurality of breathers 116A, 116B, 116C, 116D, 116E, and 116F are connected by the fumes disposal passageway 118B in series. Alternatively, the outlet 132 can be located more adjacent an end of the engine such as a back/rear of the engine between a two more outward connections with the two more outward breathers (e.g., 116E and 116F) as shown with the fumes disposal passageway 118A.

INDUSTRIAL APPLICABILITY

In operation, the engine 100 can be configured to combust fuel to generate power. While typically efficient, a small portion of the blowby gases may escape the combustion chamber past the piston and enter undesirable areas of the engine such as the crankcase 106. The present disclosure contemplate the purge system 102 can be in fluid communication with the crankcase 106 such as via the inlet passageway 126 from the intake manifold 124. The purge system 102 can be configured to supply air to the crankcase 106 from the intake manifold and through the engine block 104 or through other components (not shown) to the cylinder head 110. The air the purge system 102 supplies can act to ventilate the crankcase 106 and other components such as the cylinder head 110, the rocker box 112, etc. This ventilation can dilute fumes (un-combusted fuel, explosive gases and/or volatiles) below the lower explosive limit so as to prevent or reduce the likelihood of an explosion within the engine 100.

Figure 5:
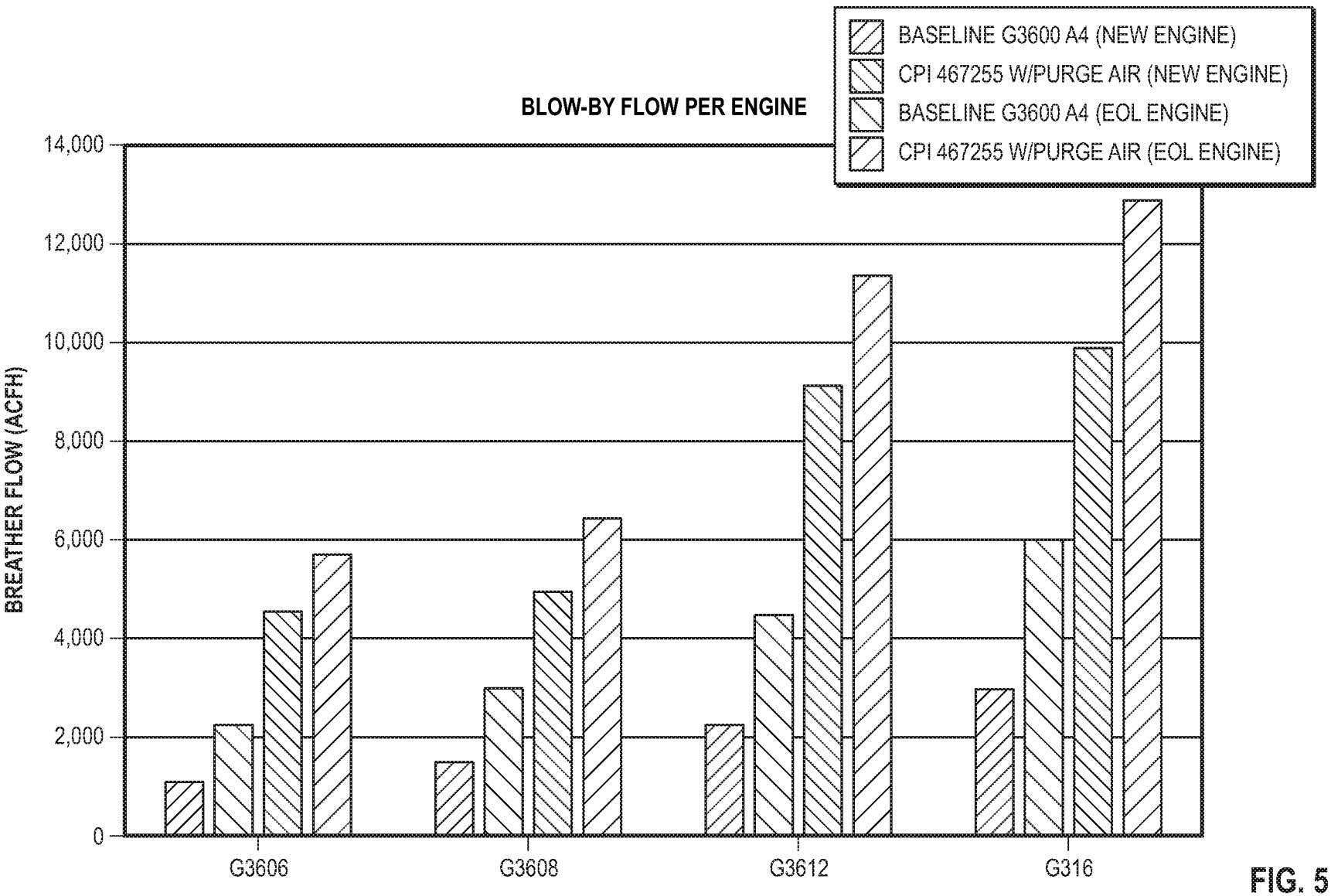
FIG. 5 is a graph of showing a breather flow rate for four engines at both a new engine and an end of life engine (EOL) timeframe for each of the four engines. The graph illustrates the breather flow rate for each of the four engines at both new engine and EOL with and without the purge system according to an example of this disclosure.
Figure 6:
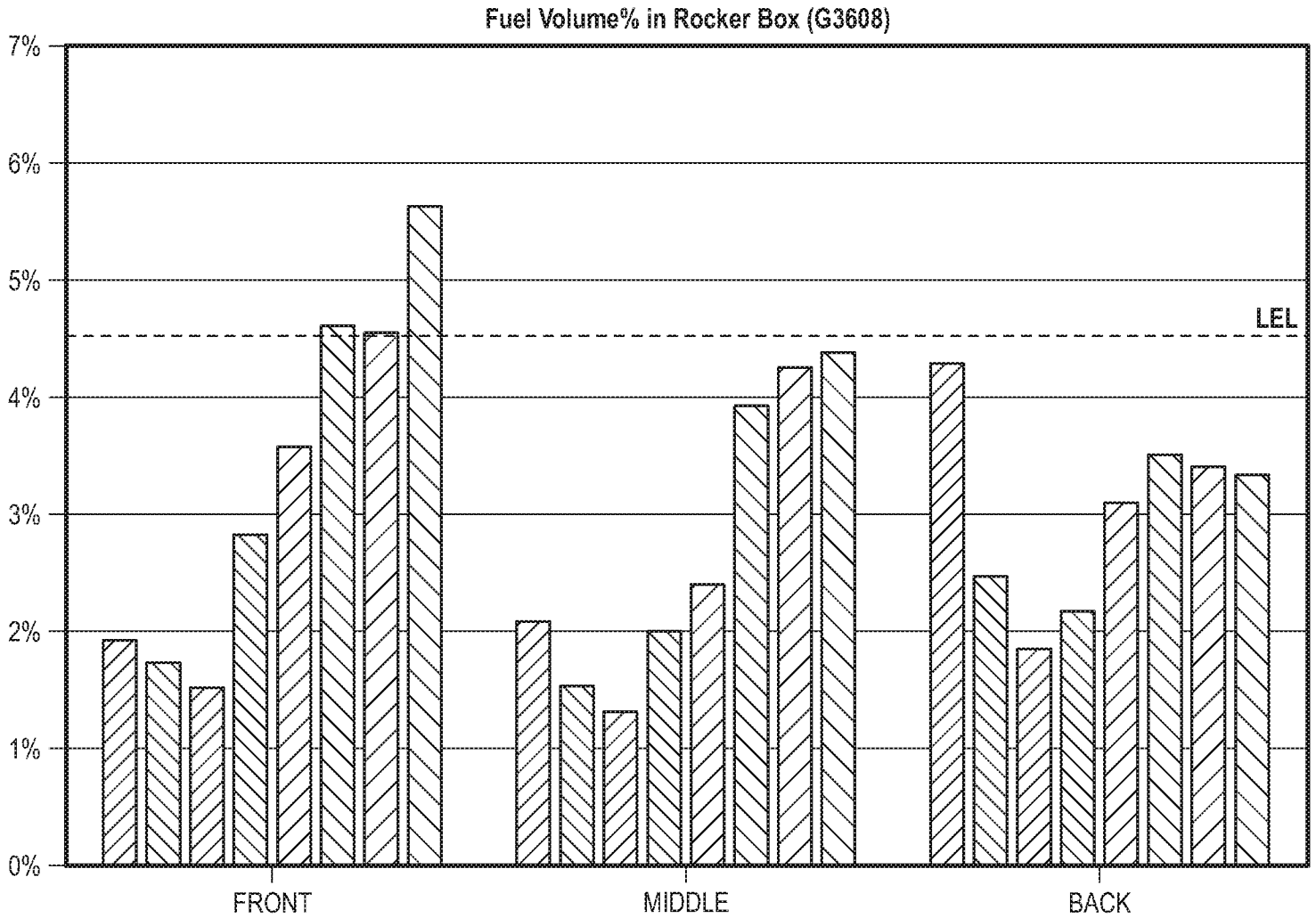
FIG. 6 is a graph of fuel percentage by volume for a plurality of rocker boxes with an outlet to a fumes disposal line in three different locations according to an example of this disclosure.

FIGS. 5 and 6 provide results of studies conducted by the inventors using the structures of the present disclosure. These studies show that, for example, the purge system 102 can be configured to supply the air to the rocker box 112 to reduce a fuel percentage by volume within the rocker box 112 to between 4.5% and 0%, inclusive. This can be below the lower explosive limit for the engine 100. The purge system 102 can be configured to supply the compressed air to the crankcase 106 at a flow rate of between about 8 grams/second and about 30 grams/second, inclusive according to some examples.

FIG. 5 illustrates a study where four engines having different capacity and blowby flow rates (measured in accumulated cubic feet per hour) are graphed. The blowby rates for these engines were measured for a new engine and EOL engine and are measured with and without the purge system 102. As shown, new engine v. EOL engine accounts for about a 2× increase in blowby generated by the engine. The graph shows that the purge air added to the engine by the purge system 102 can be constant over new engine v. EOL engine. The purge system 102 can increase the blowby through the breather as measured by breather flow as shown in TABLE 1 and graphed in FIG. 5.

TABLE 1

| | Estimated Blow-by Flow/Engine (acfh) | | | |
|---|---|---|---|---|
| | G3606 | G3608 | G3612 | G3616 |
| Baseline G3600 A4 (New Engine) | 1,125 | 1,500 | 2,250 | 3,000 |
| Baseline G3600 A4 (EOL Engine) | 2,250 | 3,000 | 4,500 | 6,000 |
| CPI 467255 w/Purge Air (New Engine) | 4,592 | 4,967 | 9,185 | 9,935 |
| CPI 467255 w/Purge Air (EOL Engine) | 5,717 | 6,467 | 11,435 | 12,935 |

The inventors also determined that the location of the outlet 132 can be a factor in reducing the fuel percentage by volume within the rocker box 112 below the lower explosive limit (shown as LEL in FIG. 6). FIG. 6 illustrates the outlet 132 placed in different locations including a front location (between the two forward most breathers of a series of the plurality of breathers), a middle location (between the two most inner of the series of the plurality of breathers) and a back location (between two rearward most breathers of a series of the plurality of breathers). FIG. 6 illustrates that in some conditions and for certain engines with a front location of the outlet 132 the fuel percentage by volume within the forward most rocker box 112 can exceed LEL. However, FIG. 6 illustrates that the middle location of the outlet 132 and the back location of the outlet 132 maintain the fuel percentage by volume within the forward most rocker box 112 below LEL.

The above detailed description is intended to be illustrative, and not restrictive. The scope of the disclosure should, therefore, be determined with references to the appended claims, along with the full scope of equivalents to which such claims are entitled.

What is claimed is:

1. An internal combustion engine comprising:
- an engine block defining a plurality of combustion cylinders and a crankcase;
- a piston moveable within each of the plurality of combustion cylinders;
- a plurality of cylinder heads each of the plurality of cylinder heads coupled to the engine block adjacent to and in fluid communication with at least one of the plurality of combustion cylinders; and
- a purge system in fluid communication with the crankcase, wherein the purge system supplies air to the crankcase and to the plurality of cylinder heads, the purge system comprising:
- a plurality of valve covers, each of the plurality of valve covers coupled to one of the plurality of cylinder heads;
- a plurality of breathers, each of the plurality of breathers coupled to one of the plurality of valve covers; and
- a fumes disposal line connected in series to all of the plurality of breathers, wherein the fumes disposal line transports fumes from all of the plurality of breathers and away from all of the plurality of the cylinder heads to an outlet that releases the fumes away from the engine.

2. The internal combustion engine of claim 1, wherein the purge system further comprises:
- a turbocharger configured to receive and compress air;
- an aftercooler in fluid communication with the turbocharger and receiving the compressed air therefrom;
- an intake manifold in fluid communication with the aftercooler, wherein the intake manifold passes a first portion of the compressed air comprising an intake air to the cylinder head and passes a second portion of the compressed air comprising the air to the crankcase; and
- an inlet line transporting the air from the intake manifold to the crankcase around an end of the engine.

3. The internal combustion engine of claim 2, wherein the inlet line includes a check valve.

4. The internal combustion engine of claim 1, wherein the fumes disposal line has the outlet positioned between a two most inner of the series of the plurality of breathers.

5. The internal combustion engine of claim 1, wherein the cylinder head includes a rocker box, and wherein the valve cover is directly coupled with the rocker box.

6. The internal combustion engine of claim 5, wherein the purge system supplies the air to the rocker box to reduce a fuel percentage by volume within the rocker box to between 4.5% and 0%, inclusive.

7. The internal combustion engine of claim 1, wherein the purge system supplies the air to the crankcase at a flow rate of between about 8 grams/second and about 30 grams/second, inclusive.

8. A method of diluting products of combustion with compressed air within an internal combustion engine, the method comprising:

directing the compressed air from an intake manifold of the internal combustion engine to a crankcase of the internal combustion engine;

passing the compressed air from the crankcase to a plurality of cylinder heads of the internal combustion engine;

passing fumes from each of the plurality of cylinder heads through a dedicated one of a plurality of breathers to a collection line connected in series to all of the plurality of breathers with the compressed air; and passing the fumes from all of the plurality of breathers along the collection line to an outlet and away from the engine.

9. The method of claim 8, wherein the outlet is positioned between a two most inner of the plurality of breathers.

10. The method of claim 8, wherein passing the compressed air from the crankcase to the plurality of cylinder heads includes maintaining a fuel percentage by volume within a rocker box of each of the plurality of cylinder heads to between 4.5% and 0%, inclusive.

11. The method of claim 8, wherein directing the compressed air from the intake manifold of the internal combustion engine to the crankcase includes supplying the compressed air to the crankcase at a flow rate of between about 8 grams/second and about 30 grams/second, inclusive.

12. A purge system for supplying compressed air to an internal combustion engine, the system comprising:

an inlet configured to couple with an intake manifold of the internal combustion engine and supply the compressed air from the intake manifold to a crankcase of the internal combustion engine;

a plurality of valve covers, each of the plurality of valve covers configured to couple to one of a plurality of cylinder heads;

a plurality of breathers, each of the plurality of breathers configured to couple to one of the plurality of valve covers; and a fumes disposal line configured to couple in series with all of the plurality of breathers, wherein the fumes disposal line is configured to transport fumes from all of the plurality of breathers and away from all of the plurality of the cylinder heads to an outlet that releases the fumes away from the engine.

13. The purge system of claim 12, wherein the inlet line includes a check valve.

14. The purge system of claim 12, wherein the fumes disposal line has the outlet positioned between a two most inner of the series of the plurality of breathers when coupled thereto.

15. The system of claim 12, wherein the purge system is configured to supply the compressed air to a rocker box to reduce a fuel percentage by volume within the rocker box of each cylinder head to between 4.5% and 0%, inclusive.

16. The system of claim 12, wherein the purge system is configured to supply the compressed air to the crankcase at a flow rate of between about 8 grams/second and about 30 grams/second, inclusive.

* * * * *